US009345284B2

(12) United States Patent
Zake

(10) Patent No.: US 9,345,284 B2
(45) Date of Patent: May 24, 2016

(54) FOOT TRAINER

(71) Applicant: YZ Studio, Inc., New York, NY (US)

(72) Inventor: Yamuna Zake, New York, NY (US)

(73) Assignee: YZ STUDIO, INC., New York, NY (US)

( * ) Notice: Subject to any disclaimer, the term of this patent is extended or adjusted under 35 U.S.C. 154(b) by 125 days.

(21) Appl. No.: 13/691,208

(22) Filed: Nov. 30, 2012

(65) Prior Publication Data

US 2013/0133223 A1 May 30, 2013

Related U.S. Application Data

(60) Provisional application No. 61/565,035, filed on Nov. 30, 2011.

(51) Int. Cl.

| | |
|---|---|
| ***A43B 7/14*** | (2006.01) |
| ***A43B 13/18*** | (2006.01) |
| ***A43B 17/00*** | (2006.01) |

(52) U.S. Cl.

CPC ..... *A43B 13/18* (2013.01); *A43B 7/141* (2013.01); *A43B 7/142* (2013.01); *A43B 7/143* (2013.01); *A43B 7/144* (2013.01); *A43B 7/1405* (2013.01); *A43B 7/149* (2013.01); *A43B 17/00* (2013.01)

(58) Field of Classification Search

CPC ..... A43B 7/14; A43B 7/1405; A43B 7/141; A43B 7/1415; A43B 7/142; A43B 7/143; A43B 7/144; A43B 13/38; A43B 17/00

USPC ..... 36/43, 44, 88, 91, 92, 140, 142–144

See application file for complete search history.

(56) References Cited

U.S. PATENT DOCUMENTS

| | | | | | |
|---|---|---|---|---|---|
| 2,546,408 | A * | 3/1951 | Riggs | 36/178 | |
| 4,033,054 | A * | 7/1977 | Fukuoka | A43B 1/0054 | 36/11.5 |
| 4,124,946 | A * | 11/1978 | Tomlin | 36/43 | |
| 4,360,027 | A * | 11/1982 | Friedlander et al. | 36/140 | |
| 4,627,177 | A * | 12/1986 | Meyers | A43B 3/0057 | 36/154 |
| 5,058,585 | A * | 10/1991 | Kendall et al. | 36/140 | |
| 6,026,599 | A * | 2/2000 | Blackwell et al. | 36/140 | |
| 6,973,743 | B1 * | 12/2005 | Mowery | 36/43 | |
| 7,426,794 | B2 * | 9/2008 | Swensen | 36/43 | |
| 7,832,119 | B2 * | 11/2010 | Gilmore | 36/44 | |
| 2003/0110662 | A1 * | 6/2003 | Gilman et al. | 36/43 | |
| 2006/0123663 | A1 * | 6/2006 | Swensen | 36/43 | |
| 2007/0277397 | A1 * | 12/2007 | Chen | 36/44 | |
| 2009/0049712 | A1 * | 2/2009 | Steszyn | A43B 7/142 | 36/91 |
| 2009/0071038 | A1 * | 3/2009 | Luthi | A43B 7/142 | 36/91 |
| 2009/0094861 | A1 * | 4/2009 | Orvitz | A43B 1/0081 | 36/91 |
| 2011/0099842 | A1 * | 5/2011 | Burke et al. | 36/44 | |
| 2012/0117818 | A1 * | 5/2012 | Slowik | 36/44 | |

* cited by examiner

*Primary Examiner* — Marie Bays
(74) *Attorney, Agent, or Firm* — Ferdinand IP, LLC

(57) ABSTRACT

A foot trainer having a generally planar footbed. A heel recess is formed in the footbed. The heel recess is positioned proximate a proximal end of the footbed. A generally longitudinal groove is formed in the footbed. The longitudinal groove extends generally along at least a portion of a lateral edge of the footbed. A transverse arch extends from the footbed medially from the longitudinal groove. The transverse arch is positioned to be disposed proximally relative to a ball of a user's foot.

14 Claims, 3 Drawing Sheets

FOOT TRAINER

CROSS-REFERENCE TO RELATED APPLICATIONS

This application claims the benefit of U.S. provisional patent application Ser. No. 61/565,035, entitled "FOOT TRAINER," filed on 30 Nov. 2011, the entire disclosure of which is incorporated herein by reference.

TECHNICAL FIELD

The present disclosure generally relates to foot trainers, and more particularly relates to foot trainers providing support for foot movement.

BACKGROUND OF THE DISCLOSURE

The feet are highly sophisticated tools that are incapable of function at birth. They need weight bearing to develop properly. Once a baby begins to bear weight, the bones of the feet begin to develop quickly. The feet, however, do not come with instructions. Thus, a child begins to walk on his feet any way he can. Only when pain and/or functional issues with the feet arise do people search for solutions to their problems.

Many shoes on the current market attempt to make walking easier and more comfortable, but do not help to train or retrain feet how to bear weight and walk properly. For example, shoes and insoles are available to help alleviate pain caused from existing bunions or collapsed arches, but do not help prevent the formation of bunions or collapsed arches.

SUMMARY OF THE DISCLOSURE

According to a first embodiment, a foot trainer may include a footbed. A heel recess may be formed in the footbed. The heel recess may be positioned proximate a proximal end of the footbed. A generally longitudinal groove may be formed in the footbed. The longitudinal groove may extend generally along at least a portion of a lateral edge of the footbed. A transverse arch may extend from the footbed medially from the longitudinal groove. The transverse arch may be positioned to be disposed proximally relative to a ball of a user's foot.

One or more of the following features may be included. The foot trainer may include a footwear article. The foot trainer may include a removable insole for a footwear article.

The heel recess may have a depth from between about 1/32 inches to about 3/32 inches.

The longitudinal groove may extend from the heel recess towards the distal end of the footbed. The longitudinal groove may be positioned to be disposed generally beneath a user's fifth metatarsal. The longitudinal groove may have a depth from between about 1/8 inches to about 3/8 inches. The longitudinal groove may have a width from between about 9/64 inches to about 27/64 inches wide The transverse arch may be configured to extend from a position proximate a user's fourth metatarsal to a position proximate a user's first metatarsal. The transverse arch may include a proximodistal rounded contour. The height of the transverse arch may increase medially. The transverse arch may incline from a height of about 1/4 inch to a height of about 1 inch.

The footbed may include a resilient material. The resilient material may include an elastomeric material. The resilient material may include a foam material.

According to another implementation, a foot trainer may include a generally planar footbed. A heel recess may be formed in the footbed and may be positioned proximate a proximal end of the footbed. A generally longitudinal groove may be formed in the footbed. The longitudinal groove may extend generally along at least a portion of a lateral edge of the footbed. A transverse arch may extend from the footbed medially from the longitudinal groove and may be positioned to be disposed proximally adjacent to a ball of a user's foot. The transverse arch may include a proximodistal rounded contour.

The details of one or more implementations are set forth in the accompanying drawings and the description below. Other features and advantages will become apparent from the description, the drawings, and the claims.

DETAILED DESCRIPTION OF THE DISCLOSURE

Figure 1:
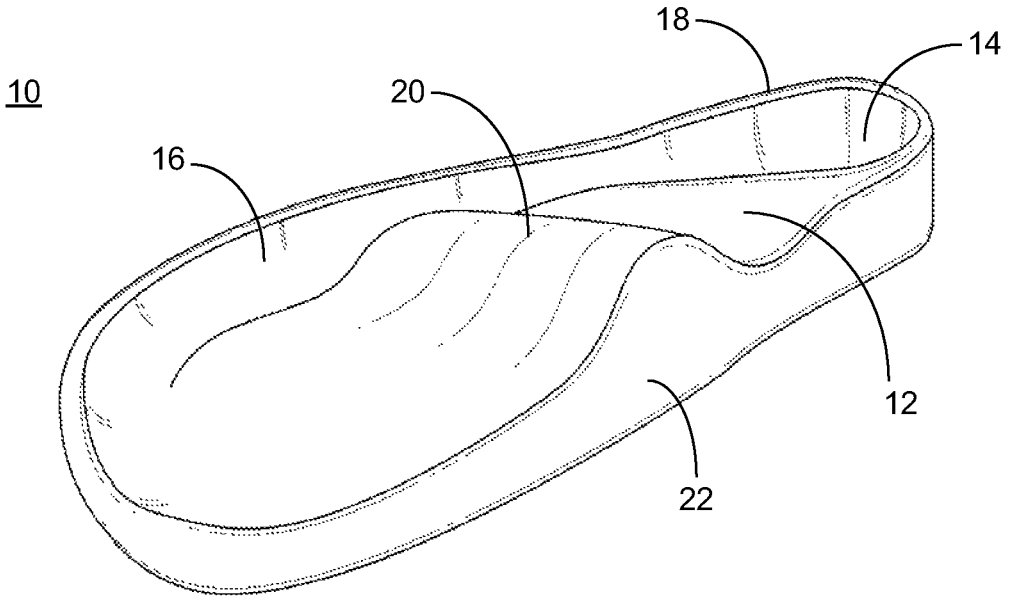
FIG. 1 is a top perspective view of an embodiment of a foot trainer.

Referring to FIG. 1, an embodiment of foot trainer 10 may generally include generally planar footbed 12. Heel recess 14 may be formed in footbed 12. As shown, heel recess 14 may be positioned proximate a proximal end of footbed 12. Foot trainer 10 may further include generally longitudinal groove 16. As shown, longitudinal groove 16 may be formed in footbed 12. Longitudinal groove 16 may extend generally along at least a portion of lateral edge 18 of footbed 12. Foot trainer 10 may further include transverse arch 20. As shown, transverse arch 20 may extend from footbed 12 medially from longitudinal groove 16. Transverse arch 20 may further be positioned to be disposed proximally relative to a ball of a user's foot (not shown). The size of foot trainer 10, as well as the relative sizes and positions of the features thereof (e.g., heel recess 14, longitudinal groove 16, and transverse arch 20) may be sized according to a user's specific foot measurements, including, but not limited to length of foot from the back of a heel to an end of the user's distal first metatarsal and/or the proximate position of the user's ball of the foot. Foot measurements may vary from user to user. However, it will be appreciated that various additional/alternative sizes may be utilized depending upon the anatomic structures of any given user's foot. Further, various generic or standard sizes may be utilized with assumed corresponding sizes and positions of anatomic features, which may be, for example, based on, at least in part, average sizes and/or positions of anatomic features of users having a corresponding foot size, or the like. The foregoing examples of anatomical locations of features of foot trainer 10 are provided for the purposes of example only, and should not be construed as a limitation of the present disclosure.

In some implementations, foot trainer 10 may be utilized to train and/or retrain a user to use his or her foot such that the foot may not collapse to the inside edge of the ankle, arch, or first metatarsal. For example, foot trainer 10 may be employed to assist a user to train and/or retrain use of the lateral side of the user's foot. In another example, foot trainer 10 may be utilized to train and/or retrain movement from the user's fifth metatarsal to the user's first metatarsal. In an embodiment, foot trainer 10 may be included as a feature of a footwear article, such as a shoe, a sneaker, a sandal, a flip-flop, or the like. For example, foot trainer 10 may be provided as an insole and/or midsole of a footwear article. In some embodiments, foot trainer 10 may be a removable insole for a footwear article, such that foot trainer 10 may be inserted to and/or removed from an existing shoe, sneaker, sandal, flip-flop, or the like. The foregoing examples of foot trainer 10 are provided for the purposes of example only, and should not be construed as a limitation of the present disclosure. For example, foot trainer 10 may be equally utilized for comfort.

Figure 2:
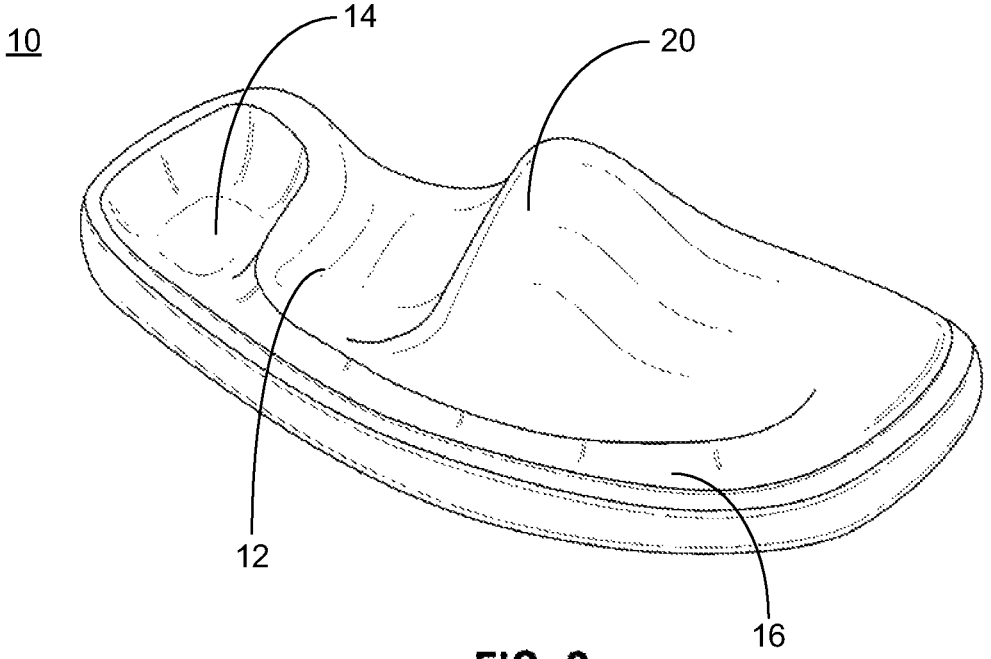
FIG. 2 is another top perspective view of the embodiment of a foot trainer of FIG. 1.

Referring to FIG. 2, and as generally discussed above, foot trainer 10 may include heel recess 14. Heel recess 14 may be formed as a recess and/or depression in footbed 12. As shown, heel recess 14 may be positioned proximate a proximal end of footbed 12. According to an embodiment, the heel recess 14 formed as a recess and/or depression in footbed 12 may create a slightly negative weight balance when in use. For example, as heel recess 14 may be slightly below nominal surface of generally planar footbed 12, in use, a user's weight may be shifted at least partially toward the proximal end of foot trainer 10. Accordingly, in use, foot motion of a user utilizing foot trainer 10 may generally be initiated from a proximal position of foot trainer 10, i.e., a position based on, at least in part, heel recess 14. Heel recess 14 may have a depth from between about 1/32 inches to about 3/32 inches. For example, in one embodiment of the present disclosure, heel recess 14 may have a depth of approximately 1/16 inch. Heel recess 14 may be generally shaped in the form of a user's heel of a foot. However, it will be appreciated that various alternative measurements may be utilized depending upon the anatomic structures of any given user's foot. The foregoing examples of measurements of heel recess 14 are provided for the purposes of example only, and should not be construed as a limitation of the present disclosure.

As also generally described, foot trainer 10 may further include generally longitudinal groove 16. As shown, longitudinal groove 16 may be formed in footbed 12. Longitudinal groove 16 may extend generally along at least a portion of lateral edge 18 of footbed 12. In some embodiments, lateral groove 16 may be medially inset from lateral edge 18. For example, longitudinal groove 16 may be positioned to be disposed generally beneath a user's fifth metatarsal. Further, in an embodiment, longitudinal groove 16 may extend from heel recess 14 towards the distal end of footbed 12. In some embodiments, longitudinal groove 16 may be at least partially distally separated from heel recess 14. Longitudinal groove 16, alone and/or in combination with heel recess 14 may generally allow weight bearing via a user's foot to be biased along the lateral edge of the foot trainer 10, e.g., with an at least initial weight bias along at least a portion of the user's fifth metatarsal. For example, as longitudinal groove 16 may generally lie below a nominal surface of generally planar footbed 12, when user foot trainer 10 a user's weight may be biased laterally, e.g., as the user's foot in the region of the fifth metatarsal may be supported within longitudinal groove 16 below the nominal surface of generally planar footbed 12. Longitudinal groove 16 may have a depth from between about 1/8 inches to about 3/8 inches and a width from between about 9/64 inches to about 27/64 inches wide. For example, in one embodiment of the present disclosure, longitudinal groove 16 may have a depth of approximately 1/4 inches and a width of approximately 9/32 inches. However, it will be appreciated that various alternative measurements may be utilized depending upon the anatomic structures of any given user's foot. The foregoing examples of measurements of longitudinal groove 16 are provided for the purposes of example only, and should not be construed as a limitation of the present disclosure.

Figure 3:
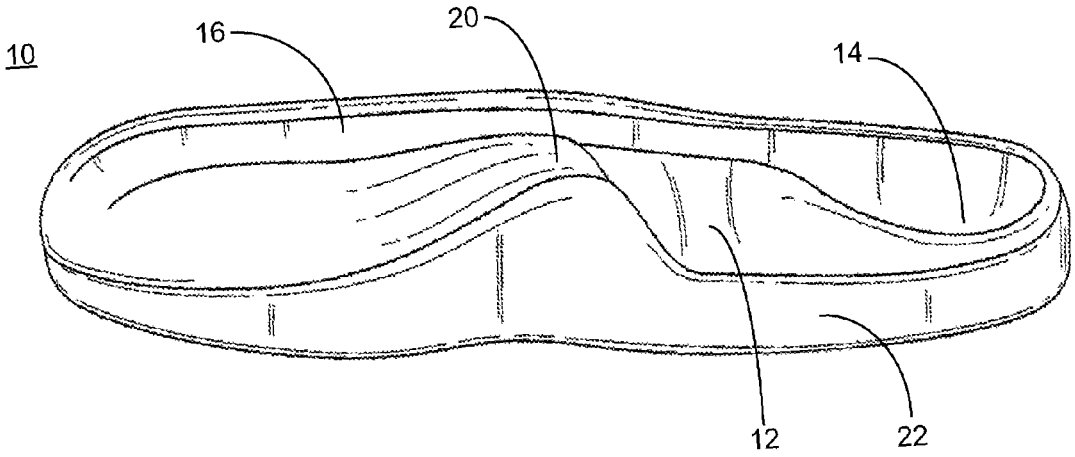
FIG. 3 is a side perspective view of the embodiment of a foot trainer of FIG. 1.
Figure 4:
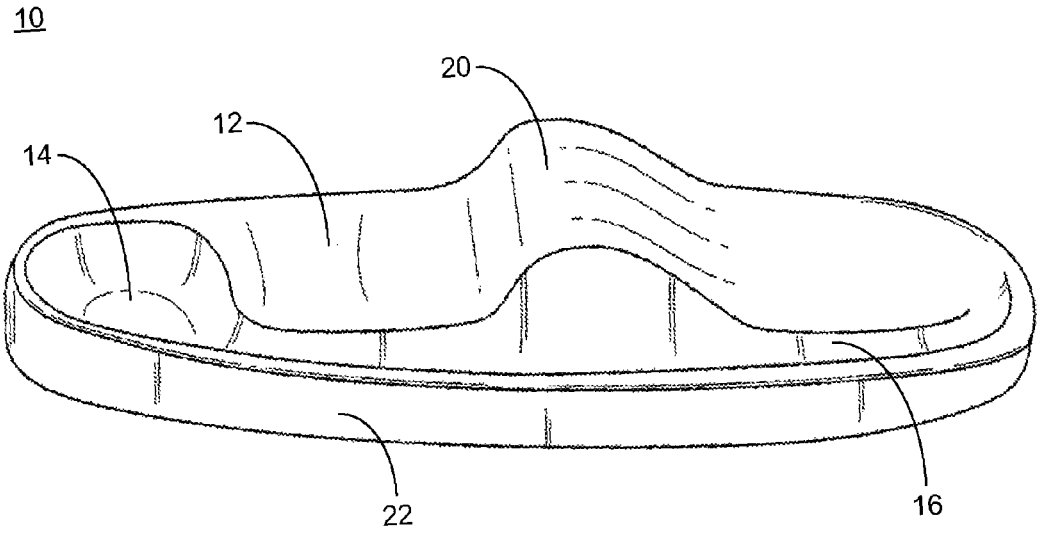
FIG. 4 is another side perspective view of the embodiment of a foot trainer of FIG. 1.
Figure 5:
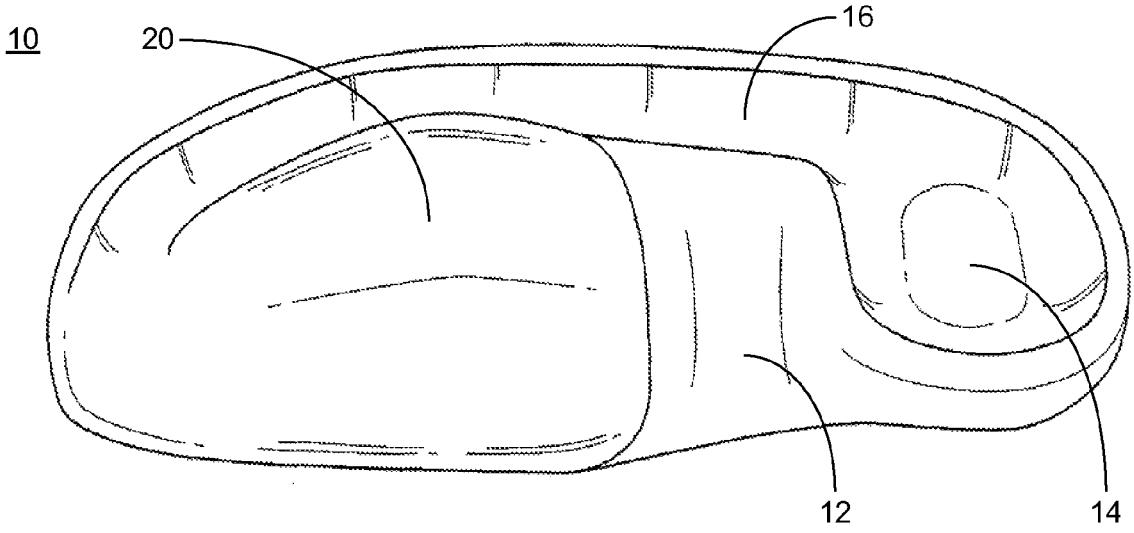
FIG. 5 depicts a plan view of the embodiment of a foot trainer of FIG. 1.

Referring to FIGS. 3-5, foot trainer 10 may include transverse arch 20. Transverse arch 20 may extend from footbed 12 medially from longitudinal groove 16. Transverse arch 20 may further be positioned to be disposed proximally relative to a ball of a user's foot (not shown). For example, transverse arch 20 may be positioned to be disposed proximally adjacent to a ball of a user's foot (not shown). In an embodiment, transverse arch 20 may be disposed in a manner behind the ball of a foot such that a user's toes are free to drop forward and have full, unrestricted movement. In one embodiment, transverse arch 20 may be configured to extend from a position proximate a user's fourth metatarsal to a position proximate a user's first metatarsal. In yet another embodiment, transverse arch 20 may be configured to extend from a position proximate a user's fifth metatarsal to a position proximate a user's first metatarsal. Further, as shown in FIG. 1, transverse arch 20 may include a proximodistal rounded contour to fit comfortably beneath the arch of a user's foot.

Figure 6:
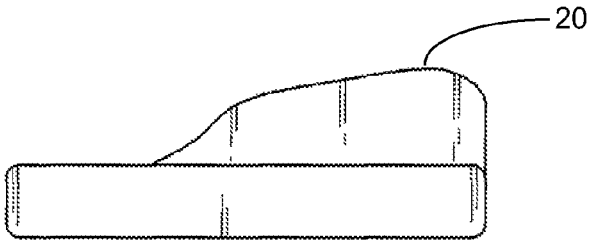
FIG. 6 depicts a front elevation view of the embodiment of a foot trainer of FIG. 1.
Figure 7:
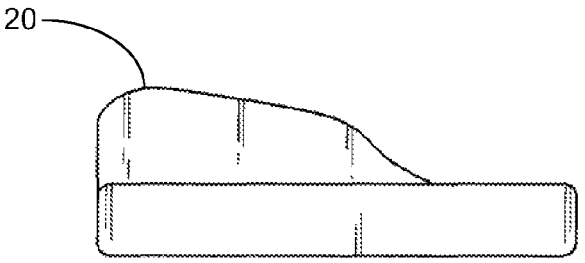
FIG. 7 depicts a rear elevation view of the embodiment of a foot trainer of FIG. 1.

Referring to FIG. 6 and FIG. 7, a height of transverse arch 20 may increase medially. For example, transverse arch 20 may incline from a height of about 1/4 inch to a height of about 1 inch from a user's fourth or fifth metatarsal to a user's first metatarsal, respectively. The incline of transverse arch 20 may support the metatarsals and prevent weight bearing into a user's toes, for example a user's largest toe, and therefore may prevent collapsed arches and bunions. For example, the incline of transverse arch 20 upward from generally planar footbed 12 in the medial direction (e.g., generally inclining upwardly from a position generally proximate a user's fourth metatarsal to a position generally proximate the user's first metatarsal) may, in some embodiments, bias a user's weight balance toward a lateral aspect of the user's foot. However, it will be appreciated that various alternative measurements may be utilized depending upon the anatomic structures of any given user's foot. The foregoing examples of measurements of transverse arch 20 are provided for the purposes of example only, and should not be construed as a limitation of the present disclosure.

Footbed 12 of foot trainer 10 may include a resilient material. Resilient materials may include, but are not limited to, an elastomeric material, rubber, foam, or other moldable plastic material. In one embodiment, footbed 12 may include various densities of resilient materials. In yet another embodiment, footbed 12 may be comprised of a combination of several resilient materials. For example, in one embodiment of the present disclosure, longitudinal groove 16 along lateral edge 18 may include a harder resilient material, while the distal end of longitudinal groove 16 may include a more flexible resilient material. In another embodiment of the present disclosure, for example, transverse arch 20 may include a harder resilient material to allow for arch support and/or a biasing of weight toward a lateral aspect of the user's foot. In yet another embodiment, transverse arch 20 may include a more flexible resilient material to allow for greater flexibility and comfort. In an embodiment, sole 22 of foot trainer 10 may include an extremely flexible material to allow for flexible movement and full mobility of a user's foot. The above-described materials are provided for the purposes of example only, and should not be construed as a limitation of the present disclosure. Any combination of materials may be used specific to a user's needs and comfort.

In use, a user may insert her foot into foot trainer 10 in various ways. For example, in one embodiment, the user may place heel into heel recess 14. The user may insert the outer lateral side of the foot into longitudinal groove 16 along at least a portion of lateral edge 18, beginning from the heel and placing the foot into longitudinal groove 16 extending to the distal end, until the length of the foot has been placed into longitudinal groove 16. The user may then place the fifth metatarsal, fourth metatarsal, third metatarsal, second metatarsal, and first metatarsal down. Transverse arch 20 may fit comfortably under the arch of the foot. In one embodiment, a user using foot trainer 10 may take steps forward from the heel of the foot to the outside lateral edge of the foot, and may then traverse weight over transverse arch 20 to the largest toe of the foot. The foregoing steps should be used as guidance only and should not be construed as a limitation of the present disclosure.

As described in the several preceding examples, various features of foot trainer 10 may be utilized (alone and/or in combination with other features) to carry out the present disclosure. Accordingly, the present disclosure should not be construed as being limited to the described illustrative examples. Various additional/alternative implementations may equally be utilized.

A number of implementations have been described. Nevertheless, it will be understood that various modifications may be made. Accordingly, other implementations are within the scope of the following claims.

What is claimed is:

1. A foot trainer comprising:

a generally planar footbed;

a heel recess having a recess height, formed in the footbed and positioned proximate a proximal end of the footbed, wherein a generally planar area having a surface height is positioned in front of the heel recess and is formed around at least a portion of the heel recess, the surface height being above the recess height;

an arch extending from the footbed and having an arch height that is above the surface height, the arch positioned forward of the generally planar area and disposed transversely along the footbed, the arch height decreasing from a medial side of the footbed toward a lateral side of the footbed; and a generally longitudinal groove formed in the footbed and having a groove height, the longitudinal groove extending from an area proximate the heel recess along a lateral edge of the footbed and past the arch toward a distal end of the footbed, wherein the groove height is between the recess height and the surface height.

2. The foot trainer of claim 1 wherein the foot trainer includes a footwear article.

3. The foot trainer of claim 1 wherein the foot trainer includes a removable insole for a footwear article.

4. The foot trainer of claim 1 wherein the heel recess has a depth from between about 1/32 inches to about 3/32 inches.

5. The foot trainer of claim 1, wherein the longitudinal groove extends from the heel recess towards the distal end of the foot bed generally beneath a user's fifth metatarsal.

6. The foot trainer of claim 1 wherein the longitudinal groove has a depth from between about 1/8 inches to about 3/8 inches.

7. The foot trainer of claim 1 wherein the longitudinal groove has a width from between about 9/64 inches to about 27/64 inches wide.

8. The foot trainer of claim 1 wherein the arch is configured to extend from a position proximate a user's fourth metatarsal to a position proximate a user's first metatarsal.

9. The foot trainer of claim 1 wherein the arch includes a proximodistal rounded contour.

10. The foot trainer of claim 1 wherein the arch inclines from a height of about 1/4 inch to a height of about 1 inch.

11. The foot trainer of claim 1 wherein the footbed comprises a resilient material.

12. The foot trainer of claim 11, wherein the resilient material includes an elastomeric material.

13. The foot trainer of claim 11, wherein the resilient material includes a foam material.

14. The foot trainer of claim 11 wherein the arch comprises a harder resilient material than the resilient material of the footbed.

* * * * *